US008820438B2

(12) United States Patent
Ross et al.

(10) Patent No.: US 8,820,438 B2
(45) Date of Patent: Sep. 2, 2014

(54) METHOD FOR CLEANING OIL FROM DRILL CUTTINGS

(75) Inventors: Stanley Ross, Calgary (CA); Michael Biersteker, Calgary (CA)

(73) Assignee: Cutting Edge Systems Inc. (CA)

( * ) Notice: Subject to any disclaimer, the term of this patent is extended or adjusted under 35 U.S.C. 154(b) by 404 days.

(21) Appl. No.: 13/273,836

(22) Filed: Oct. 14, 2011

(65) Prior Publication Data

US 2012/0090898 A1 Apr. 19, 2012

Related U.S. Application Data

(60) Provisional application No. 61/393,790, filed on Oct. 15, 2010.

(51) Int. Cl.
*E21B 21/06* (2006.01)

(52) U.S. Cl.
USPC ..... 175/66; 175/206

(58) Field of Classification Search
USPC ..... 175/66, 206, 207
See application file for complete search history.

(56) References Cited

U.S. PATENT DOCUMENTS

| | | | | |
|---|---|---|---|---|
| 4,645,608 | A | 2/1987 | Rayborn | |
| 4,942,929 | A | 7/1990 | Malachosky et al. | |
| 5,199,997 | A | 4/1993 | Stowe | |
| 5,755,892 | A | 5/1998 | Herold et al. | |
| 6,550,552 | B1 | 4/2003 | Pappa et al. | |
| 6,846,420 | B2 | 1/2005 | Reddy et al. | |
| 2005/0279715 | A1 * | 12/2005 | Strong et al. | 210/774 |
| 2008/0251454 | A1 * | 10/2008 | Waibel et al. | 210/634 |

FOREIGN PATENT DOCUMENTS

CA 2317858 A1 3/2001

* cited by examiner

*Primary Examiner* — William P Neuder
(74) *Attorney, Agent, or Firm* — St. Onge Steward Johnston & Reens LLC

(57) ABSTRACT

This application relates to an apparatus and method for cleaning drill cuttings recovered from a wellbore. Specifically, the apparatus includes an effective system for handling and washing drill cuttings at a well site to remove hydrocarbon contaminants. The system successively washes hydrocarbon contaminated drill cuttings in organic solvent and water to remove and recover the hydrocarbon contaminates, and produce cleaned drill cuttings that may enable disposal of clean drill cuttings without further treatment.

23 Claims, 6 Drawing Sheets

METHOD FOR CLEANING OIL FROM DRILL CUTTINGS

CROSS-REFERENCE TO RELATED APPLICATIONS

The present application claims the benefit under 35 U.S.C. §119(e) of the U.S. Provisional Patent Application Ser. No. 61/393,790, filed on Oct. 15, 2010, the content of which is incorporated herein by reference.

FIELD OF THE INVENTION

This application relates to an apparatus and method for cleaning drill cuttings recovered from a wellbore. Specifically, the apparatus includes an effective system for handling and washing drill cuttings at a well site to remove hydrocarbon contaminants. The system washes hydrocarbon contaminated drill cuttings in organic solvent and water to remove and recover the hydrocarbon contaminates, and produce cleaned drill cuttings that may enable disposal of clean drill cuttings without further treatment.

BACKGROUND OF THE INVENTION

In the process of drilling oil wells, segments of rock, clay or the like (hereafter drill cuttings or drilling waste) are created by the drilling process and are carried to the surface by drilling fluid circulating in the well. Drill cuttings generally range in size from fines (approximately 1 to 100 microns) to rock chips (approximately 1 to 2 cm). As is known, in addition to carrying drilling waste to the surface, the drilling fluid serves other purposes including strengthening the walls of the wellbore, preventing contamination of the well and damage to the various formations, protecting metal parts from corrosion, providing lubrication to the drilling string as well as cooling and lubricating the drill bit during drilling.

The drilling fluids used in drilling a well are often a hydrocarbon based slurry commonly referred to as an "oil mud". An oil mud is generally comprised of a high proportion of oil based fluids together with other additives that are designed to impart specific properties to the drilling fluid. Drilling fluids are often expensive fluids that constitute a significant expense of a drilling program. Moreover, as drill cuttings are carried to the surface, they will absorb hydrocarbons or will otherwise become coated with hydrocarbons contained in the oil mud and from hydrocarbons released from various formations. As a result of this contamination, the drilling waste is unfit for simple disposal at the surface. Hydrocarbon/drilling fluid contamination of the drill cuttings may be approximately 10-50% of the total volume of the drill cuttings off the drilling rig shaker system. Accordingly, at the surface, drill cuttings and the drilling fluid are subjected to various separation techniques (most commonly shakers and/or centrifuges) in order to recover as much drilling fluid as possible for re-use in the well and to stabilize the drill cuttings for disposal.

In addition, hydrocarbon contaminated drill cuttings must be stabilized and/or cleaned before disposal in order to mitigate environmental damage and comply with government regulations.

However, most drill cutting/drilling fluid separation technologies only provide a preliminary separation of drill cuttings and drill fluid with the end result being that substantial amounts of hydrocarbons (typically 10-50% of the total volume of the drill cuttings) from the drilling fluid and the formations remain coated on the drill cuttings after rudimentary surface separation. As noted above, as both drilling fluid and other hydrocarbons are valuable and government regulations require either cleaning of drill cuttings or special containment at a disposal site, there has been a need for improved techniques to recover a greater percentage of drilling fluid and hydrocarbons from drill cuttings and to provide cleaner drill cuttings that can be readily disposed of.

A review of the prior art reveals that various technologies for cleaning drill cuttings have been described. Canadian Patent No. 2,317,858 and U.S. Pat. No. 6,550,552 to Pappa et al. disclose a washing process in which drill cuttings contaminated with an oil-based drilling fluid are successively washed using ethyl acetate or hexane. U.S. Pat. No. 5,755,892 to Herold et al. discloses washing drill cutting with ecologically compatible, biologically degradable oil. U.S. Pat. No. 4,645,608 to Rayborn discloses separating oil contaminated cuttings from a drilling mud, contacting the cutting with a detergent solution to remove the oil from the cuttings and returning the oil and detergent solution to the drilling mud. U.S. Pat. No. 4,942,929 to Malachosky et al. discloses removing drill cuttings from a well and sequentially passing cuttings through a shale shaker, washing with water and disposing of the cuttings. U.S. Pat. No. 6,846,420 to Reddy et al. discloses introducing drill cuttings into a separating zone, adding an aqueous acidic solution containing a polymer substituted with an amino group and a halogenating agent such as sodium hypochlorite ("bleach") and U.S. Pat. No. 5,199,997 to Stowe discloses a first inclined tub containing a heated stripper solution, a second inclined tub containing a hot rinse liquid and a third inclined tub containing cold rinse water for removing oil from drill cuttings.

In drill cutting cleaning processes, the cuttings are often agitated to aid in the removal of hydrocarbon fluids from the cuttings. This agitation generally degrades the cuttings into smaller sized particles and fines, adding to the difficulty of separating the cuttings from hydrocarbon fluids and often leaving small fragments of cuttings or fines in recovered drilling fluids. The properties of a drilling fluid are important for the effectiveness of the drilling fluid, and fines in a recovered fluid can alter the properties of the fluid and reduce its' effectiveness. Therefore it is desirable to prevent degradation of the cuttings during cleaning.

Furthermore, it is important that the costs of cleaning contaminated drill cuttings are reasonable and/or are improved over past techniques.

SUMMARY OF THE INVENTION

In accordance with the invention, there is provided a drill cuttings cleaning system for cleaning hydrocarbon contaminated drill cuttings comprising: a pipe and auger system for operatively containing contaminated drill cuttings and a cleaning solvent and enabling counter current flow of contaminated drill cuttings and cleaning solvent with respect to one another wherein rotation of an auger within the pipe and auger system effects movement of drill cuttings with respect to the solvent for cleaning the contaminated drill cuttings.

The pipe and auger system will preferably have a top end and a bottom end and wherein the top end is positioned at a higher level relative to the bottom end and the cleaning solvent partially fills the pipe and auger system. A drill cuttings inlet is provided for the entry of contaminated drill cuttings into the pipe adjacent the bottom end and a drill cuttings outlet is provided for the exit of contaminated drill cuttings from the pipe adjacent the top end. In other embodiments, the solvent inlet for the entry of cleaning solvent into the pipe is in a mid-region of the pipe and the solvent exit is adjacent the bottom end for removing solvent from the pipe. The system may also include at least a second pipe and auger system operatively connected to the first pipe and auger system to enable successive processing of drill cuttings through both (or more) systems.

The system may also comprise a drying system operatively connected to the drill cuttings cleaning system for drying cleaned drill cuttings.

In one embodiment, the drying system comprises: an angled pipe having an upper end and a lower end; a drying system auger operatively contained in the angled pipe; a drill cuttings inlet adjacent the lower end of the angled pipe; a drill cuttings outlet adjacent the upper end of the angled pipe; a solvent vapour outlet attached to the angled pipe; and a heating system operatively connected to the drying system for heating drill cuttings within the drying system.

In another embodiment, the drying system auger includes an outer flighting having a diameter substantially equivalent to the inner diameter of the angled pipe and an inner flighting having a diameter less than the inner diameter of the angled pipe.

In one embodiment, the heating system is an external heating jacket having an internal passage, the internal passage for the circulation of a heating fluid within the internal passage. In one embodiment, the external heating jacket extends 180 degrees around the angled pipe.

In another embodiment, the inner fighting and outer flighting define a helical heating space between the inner flighting and outer flighting enabling heating fluid to be circulated between the inner flighting and the outer flighting of the drying system auger.

In yet another embodiment, the system may further comprise a distillation system operatively connected to the drill cuttings cleaning system for distilling solvent and recovering cleaned solvent and hydrocarbons for re-use.

In another embodiment, the system may also include a purge gas system operatively connected to the drill cuttings cleaning system for circulating a purge gas within the drill cuttings cleaning system.

In yet another embodiment, the a drill cuttings cleaning system for cleaning hydrocarbon contaminated drill cuttings is provided comprising: an angled pipe having a top end, middle portion and a lower end, the angled pipe operatively containing an auger for countercurrent movement of contaminated drill cuttings and a cleaning solvent with respect to one another within the angled pipe, the angled pipe having a drill cuttings inlet adjacent the lower end, a drill cuttings outlet adjacent the top end, solvent inlet adjacent the middle portion and a solvent outlet adjacent the lower end; wherein rotation of the auger within the pipe effects movement of drill cuttings with respect to the solvent for cleaning the contaminated drill cuttings without substantial degradation of particle size of the drill cuttings; a drying system operatively connected to the angled pipe, the drying system comprising: a drying pipe angled to define an upper end and a lower end; a drying auger operatively contained in the angled pipe, the drying auger having an outer flighting and an inner flighting; a dryer drill cuttings inlet adjacent the lower end of the drying pipe; a dryer drill cuttings outlet adjacent the upper end of the drying pipe; a solvent vapour outlet attached to the drying pipe; and a heating system operatively connected to the exterior of the drying pipe for heating drill cuttings within the drying pipe.

In another aspect, a method of cleaning drill cuttings in at least one pipe and auger cleaning system comprising the steps of: a) introducing contaminated drill cuttings and a cleaning solvent into the pipe and auger cleaning system; b) flowing the contaminated drill cuttings and cleaning solvent in a countercurrent direction with respect to one another; c) collecting and distilling cleaning solvent from the pipe and auger cleaning and re-circulating cleaned solvent through the pipe and auger cleaning system; and, d) recovering cleaned drill cuttings from the pipe and auger cleaning system and introducing the cleaned drill cuttings into a drying system.

In another embodiment, the auger of the pipe and auger system is rotated at a rate that does not cause substantive structural degradation of the contaminated drill cuttings.

In another embodiment, the drying system is a pipe and auger drying system and step d) further comprises: heating the pipe and auger drying system to effect evaporation of solvent from the cleaned drill cuttings while moving cleaned drill cuttings within the pipe and auger drying system.

In various embodiments, the ratio of solvent to drill cuttings in the pipe is at least 2:1. Preferred cleaning solvent is any one of n-butyl alcohol, hexane or ethyl acetate.

In another aspect, a method for cleaning hydrocarbon contaminated drill cuttings with a cleaning solvent is provided comprising the steps of: i) conveying contaminated drill cuttings through a partially used organic solvent and thereafter separating partially cleaned drill cuttings and used organic solvent; ii) conveying the partially cleaned drill cuttings through a clean organic solvent and thereafter separating cleaned drill cuttings and partially used organic solvent; recovering the partially used organic solvent from step ii) for use in step i); and, distilling used organic solvent from step i) for recovery of clean organic solvent for step ii) and hydrocarbon contaminants.

BRIEF DESCRIPTION OF THE DRAWINGS

The invention is described with reference to the accompanying figures in which.

DETAILED DESCRIPTION OF THE INVENTION

Figure 1:
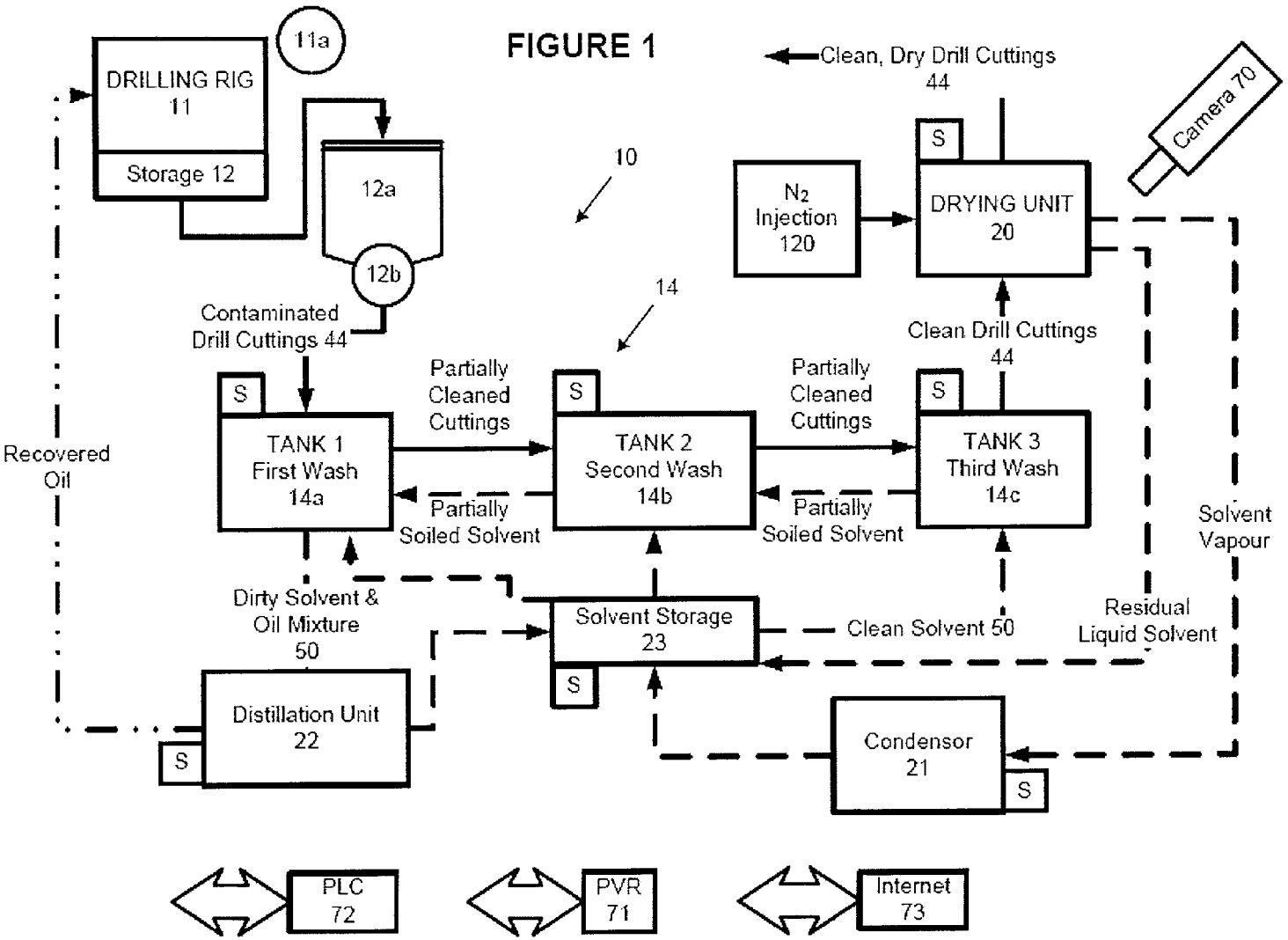
FIG. 1 is a schematic view of a drill cuttings washing system in accordance with one embodiment of the invention.

With reference to the figures, systems and methods for cleaning drill cuttings recovered from a wellbore during oilfield drilling operations are described. FIG. 1 shows a schematic overview of a system 10 and FIGS. 2-5A show preferred design features of the system.

As shown, the system 10 generally includes a storage/delivery system 12 for receiving drill cuttings from a drilling rig 11, 11*a*, a wash system 14, a drying system 20, a condenser 21 and a distillation system 22. The wash system 14 preferably includes a first wash system 14*a*, a second wash system 14*b* and a third wash system 14*c*. Drill cuttings 44 (contaminated and cleaned) and solvent 50 (clean and contaminated) are moved through the system as shown generally by the solid and dotted-line arrows in FIGS. 1, 2 and 3. The system may also include one or more cameras 70, a personal video recorder (PVR) 71 and a programmable logic controller (PLC) that may each be operatively connected to the internet 72 for remote monitoring, control and reporting. While the system is generally described with three wash systems, it is understood that one or more wash systems can be utilized in accordance with the invention.

Storage/Delivery System

Drill cuttings contaminated with drilling fluid and/or hydrocarbons from a wellbore 11*a* and drilling rig 11 are deposited into the storage/delivery system 12 after the drill cuttings have been removed from a standard shaker (not shown) at a drilling site. In the preferred embodiment, the storage/delivery system is a hopper bin 12*a* with an auger 12*b* that can be operated to receive and gently move the drill cuttings from the hopper bin to the first wash system 14*a*. In typical operation for normal processing volumes, the hopper bin and auger can move drill cuttings at a rate of approximately 16 volumetric liters per minute.

Wash System

Figure 2:
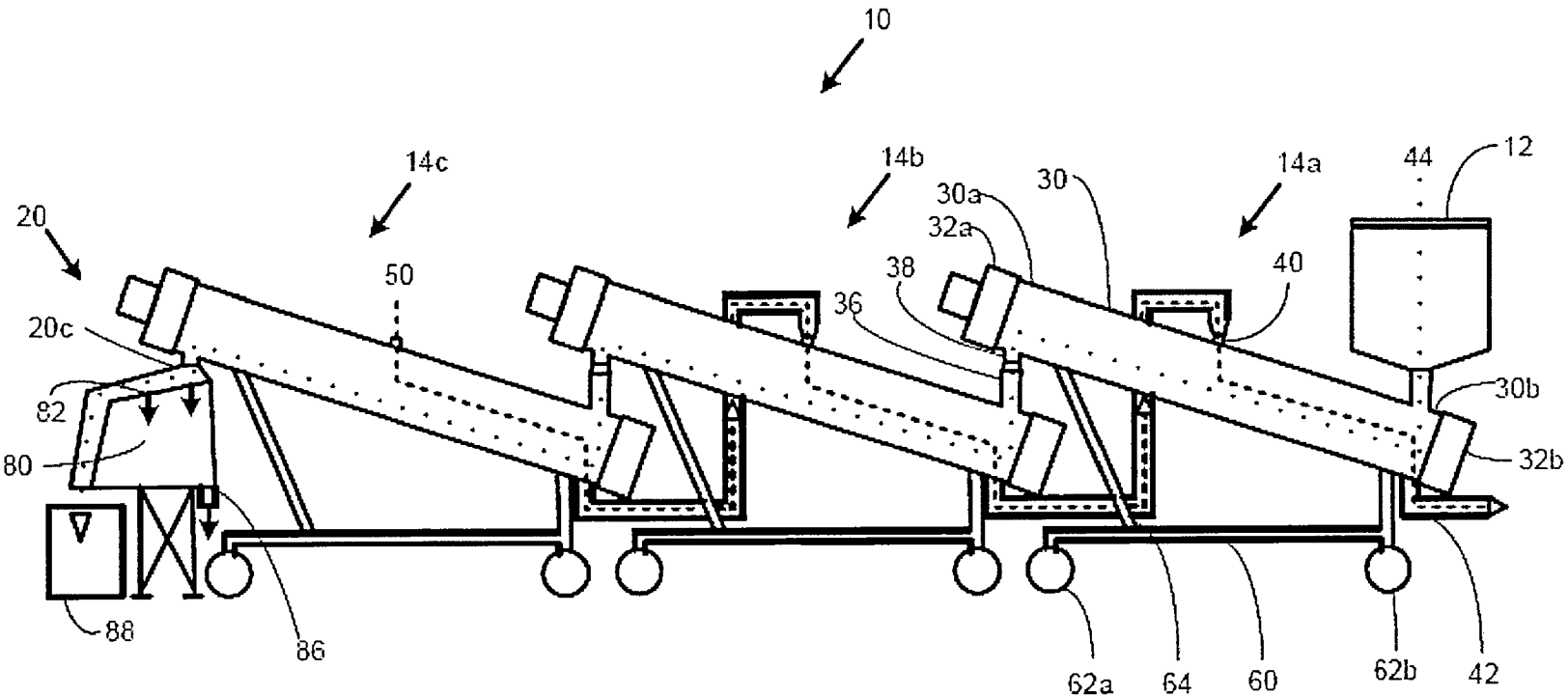
FIG. 2 is a schematic side view of a drill cuttings washing apparatus in accordance with one embodiment of the invention.

The first 14*a*, second 14*b* and third 14*c* wash systems are substantially similar to each other as shown in FIG. 2. A representative wash system 14, as shown in greater detail in FIG. 3, includes a round pipe 30 positioned in an upward angle of approximately 15°; the round pipe including a top end 30*a* sealed with a top end cap 32*a*, a bottom end 30*b* sealed with a bottom end cap 32*b*, a cuttings inlet 36, a cuttings outlet 38, a solvent inlet 40 and a solvent outlet 42. A rotatable auger 34 is located inside the pipe for moving cuttings 44 from the bottom end of the pipe to the top end. The auger is driven by an auger drive system 34*a*. In operation, the pipe is partially filled with solvent 50 to create a solvent flooded area 52 inside the pipe and a "dry" area 54. The wash system is supported by a chassis 60 that may include a first and second wheel 62*a*, 62*b* to enable easy movement of each wash system at a well site. The chassis will preferably have an adjustable leg 64 connected to the pipe 30 to allow the angle of the pipe to be easily adjusted by moving the leg.

During operation, drill cuttings 44 are conveyed into the cuttings inlet 36 where they are contacted with the solvent 50 and moved via the auger 34 through the solvent flooded area 52 to the dry area 54 and out the pipe through the cuttings outlet 38. The auger rotates at a speed necessary to convey the cuttings at a rate sufficient to ensure mixing of cuttings and solvent and to ensure that the cuttings are immersed for an appropriate time within the solvent flooded area for the cuttings to be cleaned to a desired level but not significantly degraded into smaller particles and fines from aggressive processing. In addition, the auger is rotated at a speed to ensure that the drill cuttings spend sufficient time in the dry area to allow solvent to drain off the cuttings and generally prevent excessive carry-over of solvent through cuttings outlet 38. Under typical processing volumes and conditions, a preferred auger speed is approximately 1 rpm that provides a contact time between the solvent and the cuttings of about 20 minutes. Under these conditions, cuttings will spend about 5 to 10 minutes in the dry area where much of the remaining solvent on the cuttings is evaporated and/or drains off the cuttings.

In a preferred embodiment, the pipe 30 is approximately 36" in diameter and approximately 20 feet long. Under normal operating conditions, the volume inside the pipe including solvent and cuttings create a flooded area that covers the bottom 12' of the pipe, leaving the last 8' as the dry area. This flooded volume is about 1000 L (36 cubic feet), comprised of approximately 650 to 700 L of solvent and 300 to 350 L of drill cuttings in order to achieve a desired 2:1 ratio (v/v) of solvent to drill cuttings.

The first, second, and third wash system are positioned relative to one another as shown in FIG. 2 with the cuttings outlet 38 of the first wash system positioned directly above the cuttings inlet 36 of the second wash system, and the cuttings outlet of the second wash system positioned directly above the cuttings inlet of the third wash system. This positioning allows the cuttings to drop directly from one wash system to another wash system, minimizing the handling and hence degradation of the cuttings. The cuttings outlet of the third wash system is positioned directly above the drying system 20 to allow the cuttings to drop directly from the third wash system to the drying system. Ideally, each connection is sealed to prevent the escape of solvent vapours.

Drying System

As shown in FIG. 2, in one embodiment, the drying system 20 includes a container 80 with a screen 82 positioned across the top opening of the container. Fully cleaned and mostly dry cuttings are emitted from the cuttings outlet of the third wash system through an air lock 20*c* onto the screen where air is drawn through the screen to draw any residual solvent from the cuttings into the container 80 below. The container has a drying system solvent outlet 86 in which the solvent exits the container for re-use and/or cleaning. The fully dry cuttings are then moved from the screen into a totebox 88 for disposal.

Figure 4:
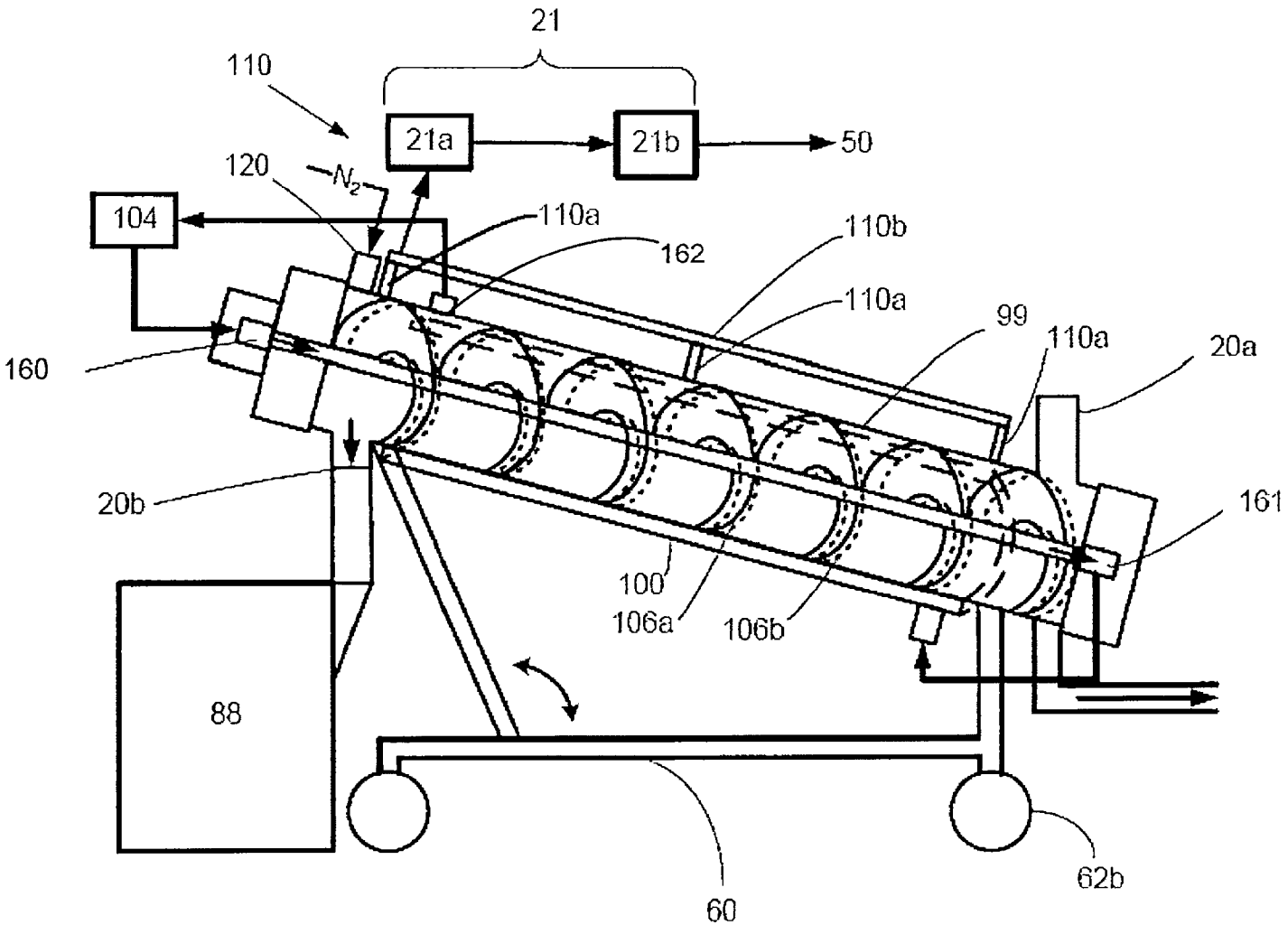
FIG. 4 is a schematic side view of a drying system in accordance with one embodiment of the invention; and, FIG. 5 is a schematic cross-sectional view of a drying system in accordance with one embodiment of the invention.
Figure 5A:
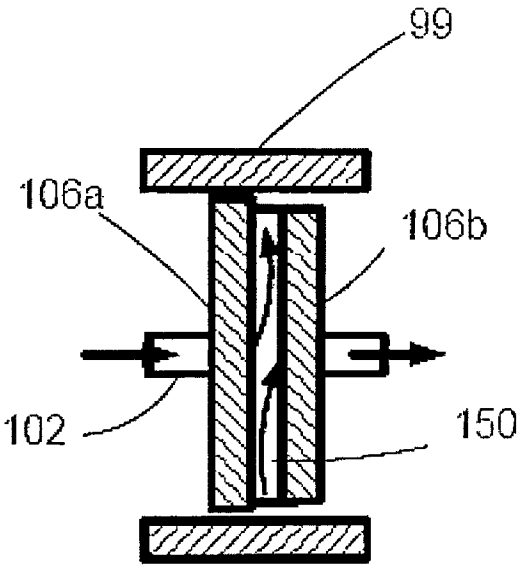
FIG. 5A is a schematic cross-sectional view of a dual flighting and heating system in accordance with one embodiment of the invention and, FIG. 6 is a schematic cross-sectional view of a wash system showing the position of nozzles for preventing the build-up of residue within the system.
Figure 5:
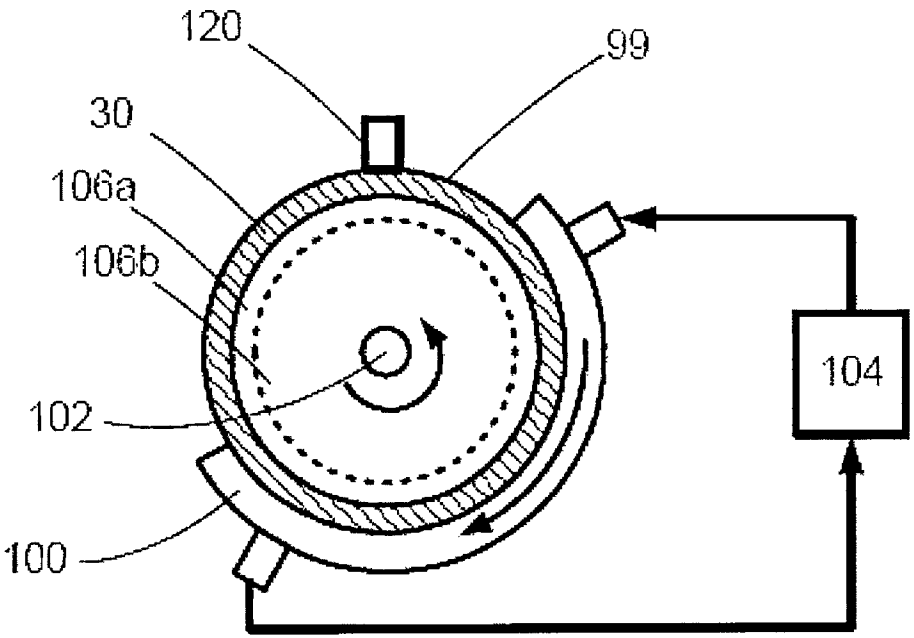

In another embodiment as shown in FIGS. 4 and 5, the drying system 20 includes a tank of similar design to the wash tanks. In this embodiment, the drill cuttings enter the dryer through an inlet 20*a* at one end and are conveyed up the dryer tank 99 to an outlet/air lock 20*b* where the cuttings drop into totebox 88. Unlike the washing units, the dryer applies heat to the exterior of the tank and the auger fighting to promote evaporation of solvent from the cleaned drill cuttings. As shown in FIGS. 4 and 5, the drying system preferably includes a heating jacket 100 surrounding the outer surface of the tank. As best shown in FIG. 5, the heating jacket is positioned around the outer surface of the tank from an approximate 2 o'clock position to an approximate 8 o'clock position (180 degrees) to ensure a more direct heating of the tank contents without heating the tank in positions where drill cuttings are not in contact with the tank walls. As understood by those skilled in the art, during normal counter-clockwise operation of the drying system, auger 102 (as shown in FIG. 5) causes drill cuttings to be dragged up the side of the tank 99 thereby causing the drill cuttings to preferentially contact one side of the tank. Preferably, the heating jacket provides approximately 82 $ft^2$ of heated surface area for a 1 m diameter auger. The heating jacket includes an inlet 100*a* and outlet 100*b* to allow a heating fluid, such as hot oil, to be circulated within the jacket and provide efficient heating of the tank. The heating fluid includes an appropriate heating and pumping system 104 for heating and circulating the heating fluid.

In a preferred embodiment, the heating system also includes double auger flighting 106*a*, 106*b* having different diameters, through which the heating fluid flows. As shown in FIGS. 4 and 5, the outer flighting 106*a* substantially corresponds in diameter to the inner diameter of the tube whereas the inner flighting 106*b* has a moderately smaller diameter. Preferably, a helical space 150 is provided between the inner flighting 106*b* and outer flighting 106*a* so as to further improve the heat transfer and hence drying capabilities of the unit. In this embodiment, the auger shaft 102 allows the passage of hot heating fluid through the auger shaft and within the helical space 150 between the inner and outer flighting.

Ideally, the inner flighting and outer flighting are spaced apart by approximately ½" to allow for the heating fluid to flow between the inner flighting and the outer flighting. The heating fluid enters the shaft of the auger through a first rotary manifold 160, flows through the helical space 150 (FIG. 5A) and exits the flighting at the opposite end of the auger through a second rotary manifold 161. From the second rotary manifold, the heating fluid preferably flows through the heating jacket, whereupon it is discharged from port 162 and reheated and pumped by heating and pumping system 104.

As noted above, the use of heating fluid between the inner and outer flighting increases the total heated surface to provide thorough contact between the cleaned drill cuttings and the heated surfaces in the tank. In the preferred embodiment, the heated surface area when the heating jacket is used in conjunction with the heated flights is greater than 300 $ft^2$.

In addition, the smaller diameter of the inner flighting prevents additional friction forces (drag) between the inner fighting and the inner walls of the tanks. The reduced friction allows for easier turning of the auger and improved operating costs as less energy is required to operate the auger.

Liquid solvent in the drying system is vapourized and recovered. As shown in FIG. 4, the drying system also includes a solvent recovery system 110 for recovering and condensing solvent vapours from the drying system. Solvent vapours are recovered from solvent vapour ports 110*a* and passed through manifold 110*b* under the operation of a fan 21*a*. Recovered vapours are condensed in solvent vapour condenser 21*b* for return to solvent storage 23.

Due to the flammable nature of solvents, the dryer will preferably include a purge gas system 120 to reduce the possibility of fire or explosions within the system. Appropriate purge gases such as nitrogen can be utilized to ensure a low oxygen environment within the drying system as well as the first, second and third wash tanks. The purge gas system may be individually configured to each unit each with a separate recirculation system, or to the entire system having a single recirculation system. In each case, the purge gas is preferably circulated, recovered and recirculated through each unit within the system.

Solvent Flow

The solvent flow through the third, second and first wash systems is controlled in such a way to conserve solvent and to generally have the cleanest solvent contacting the cuttings last and the most contaminated solvent having initial contact with the cuttings. Clean solvent is injected into the solvent inlet of the third wash system and the partially contaminated solvent exiting the third wash system drain is pumped into the solvent inlet of the second wash system, where it pushes the more contaminated solvent out the drain of the second wash system. This more contaminated solvent is then pumped into the solvent inlet of the first wash system, pushing fully contaminated solvent out the drain of the first wash system where it is pumped to the distillation system 22 for cleaning. The successive flow of solvent through the wash systems decreases the amount of solvent required compared to other systems, therefore decreasing the amount of solvent that must be distilled and decreasing the energy consumption of the system.

As the solvent progresses through each of the third, second and first wash systems undergo, the solvent will be subject to greater contamination with hydrocarbon fluids as the hydrocarbon fluids are removed from the cuttings by the solvent. As such, during the drill cuttings cleaning process, additional clean solvent may be optionally injected into each wash system to enhance the cleaning effect in each wash system. In this case, additional solvent may enter wash system through the main solvent inlet 40. To keep the level of solvent in the wash systems steady, the solvent must leave each wash system at the same rate as total solvent enters the pipe. Due to the upward angle of the pipe, as the cleaner solvent enters the pipe, the dirtier solvent will flow to the bottom end of the pipe and out through the solvent drain 42 that may include an appropriate valve to control flow rates. The preferred rate of solvent addition and removal is approximately 16 liters to 32 liters per minute for a system having a 1 meter diameter tank and auger.

Figure 6:
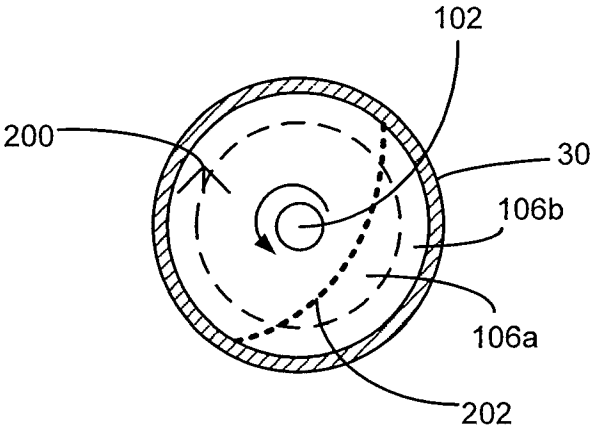

Solvent may also be injected into each washing system using a series of nozzles 200 that distribute the flow of solvent across a defined zone of the washing system. Such nozzles will preferably be positioned along the side of the auger system that does not have drill cuttings being dragged up as shown in FIG. 6 and be positioned so as to assist in preventing the build up of oily residues on the interior surfaces of the pipe and auger. That is, in normal operation, as the drill cuttings are being conveyed by the auger, a cuttings profile 202 will tend to form as shown in FIG. 6 where due to the direction of rotation, cuttings will tend to rise up one side of the auger thus defining one zone that is continuously covered by cuttings and a second zone that is not covered by cuttings but may carry a residue of oils/solvents that may adhere to the tube and auger. Thus, it is preferred that the tube be provided with nozzles that are positioned in locations that allow for the distribution of solvent against the auger and tube wall to prevent the build up of residues.

Figure 3:
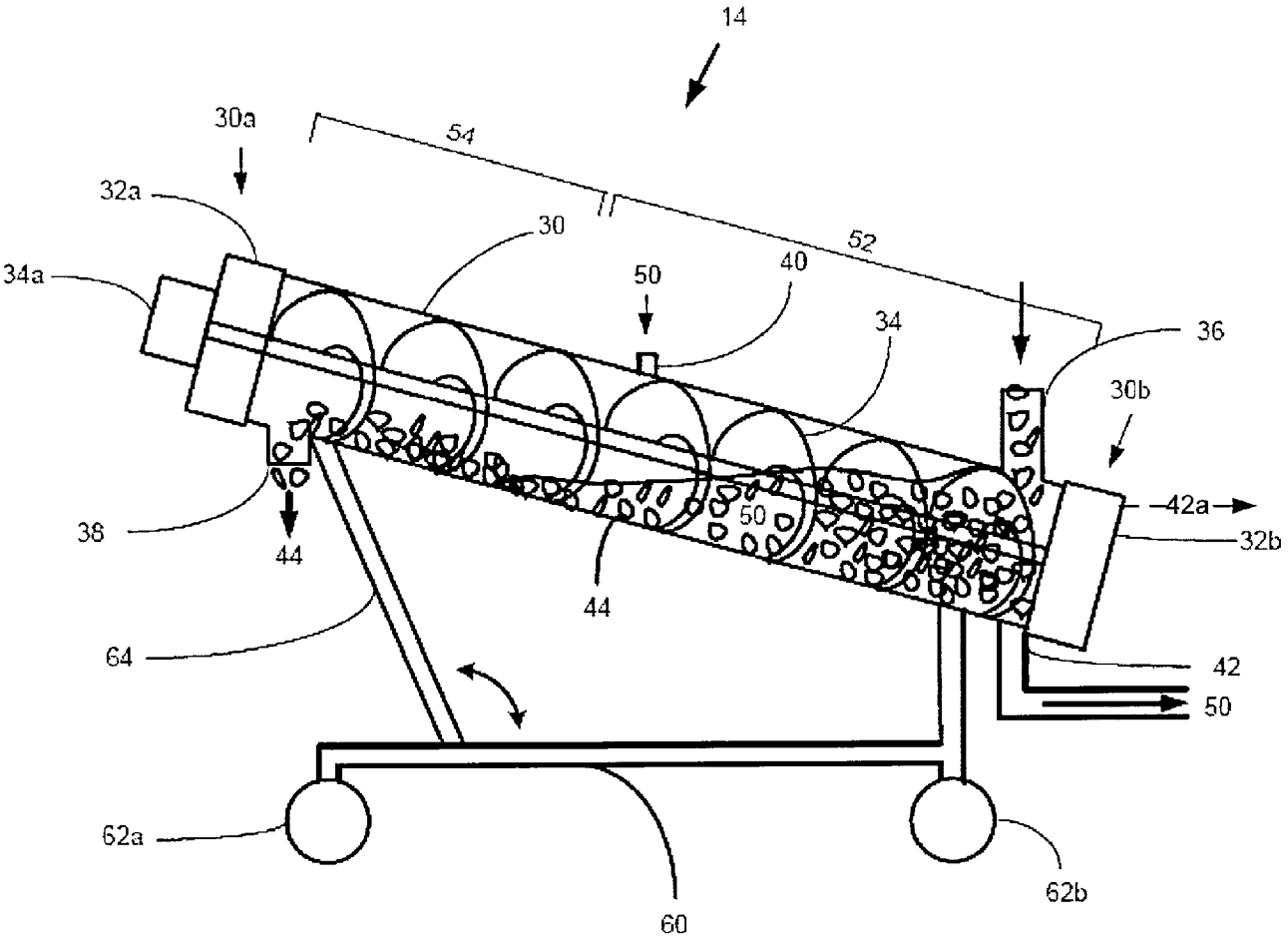
FIG. 3 is a schematic side view of a drill cuttings wash tank in accordance with one embodiment of the invention.

The location of the solvent drain may also be varied to assist in the separation of water from the system. For example, the solvent drain 42 may be positioned at a higher position 42*a* at the lower end of the wash system so as to enable water and solvent to be removed from the system at different locations. That is, in the case where the water is not miscible and is denser than solvent, water may be removed from a lower region (42 as shown in FIG. 3) and solvent is removed from the higher region 42*a*.

An alternate number of washing systems may be used instead of three depending on the volumes of cuttings being processed and/or the relative degree of contamination of cuttings and/or the economics of a particular system. For example, one, two or four or more washing systems could be used.

Distillation System

The distillation system 22 is a typical distillation system known to those versed in the art. The contaminated solvent exiting the first wash system solvent overflow valve is pumped into the distillation system where it is separated into clean solvent and hydrocarbon fluids. Both the solvent and hydrocarbon fluids can be re-used.

Solvent

Preferred solvents for use in the system include N-Butyl Alcohol, Ethyl Acetate and Hexane. In certain applications, N-Butyl Alcohol is a preferred solvent as it has been determined to be efficient in the removal of oil from drill cuttings, thereby increasing the cost effectiveness of the system. N-Butyl Alcohol also has a higher flash point than the other two solvents, thereby decreasing safety risks at a worksite. However, in some applications, N-butyl Alcohol can be disadvantaged as it is miscible with water which can decrease its effectiveness if the contaminated drill cuttings have substantial water contamination. Hexane is also an effective solvent which, in certain applications, is advantaged over N-butyl alcohol as it is less miscible with water, and hence allows for water contamination to be effectively separated from the solvent and hydrocarbons. However, when compared to the effectiveness of N-butyl alcohol in situations where water contamination is very low, hexane is a less effective solvent.

Thus, the choice of solvent will depend on particular field situations and/or applications.

System Sensors and Control

In a preferred embodiment, the system is automated such that a single operator can monitor and adjust the equipment as required during a typical drill cutting cleaning job and maintain safe operation of the system. Such sensors designated as S in the drawings include, level transducers to determine solids & liquid levels in the tanks, pressure transmitters to monitor pressure within the system and to determine if any part of the system is over-pressurizing which could cause imminent failure, temperature probes to measure heat loss and heat gain throughout the different components of the system, flow totalizers to measure solvent movement throughout the various stages of the system, and video cameras 70 for off site monitoring of the equipment when in use. Each of the sensors and/or cameras 70 may be configured to an appropriate programmable logic controller (PLC) 72 and/or personal video recorder (PVR) 71 as appropriate. Communication and control may be performed over the internet 73.

EXAMPLES

Extensive field testing was conducted to determine the effectiveness of the system against contaminated drill cuttings. In a first test, drill cuttings contaminated with approximately 30% hydrocarbons by volume were added to a system having two successive mix tank systems and subjected to cleaning at a rate of 16 volumetric liters of n-butyl alcohol solvent per minute.

More specifically, a solvent to drill cuttings ratio of 2:1 (by volume) was maintained with solvent being added at 16 liters per minute. For the two-tank system, the results showed a reduction in the hydrocarbon contamination on the cleaned cuttings to a level between 1-2% by volume as shown in Table 1. The addition of a third tank substantially improved the separation to a level less than 1% by volume.

TABLE 1

Field Trials

| Sample | Wash Stages | Solvent/ Cuttings | Initial Contamination (vol %) | Final HC Contamination (ppm) | Final HC Contamination (vol %) |
|---|---|---|---|---|---|
| 1 | 2 | 2:1 | 30 | 9903 | 1 |
| 2 | 2 | 2:1 | 30 | 18,854 | 2 |
| 3 | 3 | 2:1 | 50 | 1,609 | 0.2 |
| 4 | 3 | 2:1 | 50 | 2,095 | 0.25 |
| 5 | 3 | 2:1 | 50 | 5,238 | 0.65 |
| 6 | 3 | 2:1 | 50 | 2,874 | 0.29 |

The cleaned drill cuttings upon recovery at the totebox had a dry consistency with effectively no visible contamination particularly for those drill cuttings subjected to three wash stages. In addition, as a result of the relatively low rpm operation of the augers, the drill cuttings are subjected to minimal turbulence within the auger system such that the recovered drill cuttings are not degraded in size. This is important as the substantial generation of fines can result in contamination of any recovered fluids wherein it may become necessary to subject those fluids to subsequent and aggressive separation techniques to remove the fines.

Importantly, as a result of the low hydrocarbon contamination, the cuttings could be handled without further remediation.

As a result, it can be seen that the system is very effective in hydrocarbon removal from drill cuttings.

It should also be noted that the systems and methods described herein are related to contaminated drill cuttings, the systems and methods may also be effectively used with other contaminated materials such as soil. Similarly, contaminants may not be strictly limited to hydrocarbons related to the oil industry but could be other contaminants from other industries.

Although the present invention has been described and illustrated with respect to preferred embodiments and preferred uses thereof, it is not to be so limited since modifications and changes can be made therein which are within the full, intended scope of the invention as understood by those skilled in the art.

What is claimed is:

1. A drill cuttings cleaning system for cleaning hydrocarbon contaminated drill cuttings comprising:

a pipe and auger system for operatively containing contaminated drill cuttings and a cleaning solvent and enabling counter current flow of contaminated drill cuttings and cleaning solvent with respect to one another wherein rotation of an auger within the pipe and auger system effects movement of drill cuttings with respect to the solvent for cleaning the contaminated drill cuttings; and a drying system operatively connected to the drill cuttings cleaning system for drying cleaned drill cuttings, wherein the drying system comprises:

an angled pipe having an upper end and a lower end;

a drying system auger operatively contained in the angled pipe;

a drill cuttings inlet adjacent the lower end of the angled pipe;

a drill cuttings outlet adjacent the upper end of the angled pipe;

a solvent vapour outlet attached to the angled pipe; and a heating system operatively connected to the drying system for heating drill cuttings within the drying system.

2. The system as in claim 1 wherein the pipe and auger system has a top end and a bottom end and wherein the top end is positioned at a higher level relative to the bottom end.

3. The system as in claim 2 wherein the cleaning solvent partially fills the pipe and auger system.

4. The system as in claim 1 further comprising a drill cuttings inlet for the entry of contaminated drill cuttings into the pipe adjacent the bottom end.

5. The system as in claim 1 further comprising a drill cuttings outlet for the exit of contaminated drill cuttings from the pipe adjacent the top end.

6. The system as in claim 1 further comprising a solvent inlet for the entry of cleaning solvent into the pipe in a mid-region of the pipe.

7. The system as in claim 1 further comprising a solvent exit adjacent the bottom end for removing solvent from the pipe.

8. The system as in claim 1 further comprising a second pipe and auger system operatively connected to the pipe and auger system to enable successive processing of drill cuttings through both systems.

9. The system as in claim 1 wherein the drying system auger includes an outer flighting having a diameter substantially equivalent to the inner diameter of the angled pipe and an inner flighting having a diameter less than the inner diameter of the angled pipe.

10. The system as in claim 9 wherein the heating system is an external heating jacket having an internal passage, the internal passage for the circulation of a heating fluid within the internal passage.

11. The system as in claim 10 wherein the external heating jacket extends 180 degrees around the angled pipe.

12. The system as in claim 9 wherein the inner flighting and outer flighting define a helical heating space between the inner fighting and outer flighting enabling heating fluid to be circulated between the inner flighting and the outer flighting of the drying system auger.

13. The system as in claim 1 further comprising a distillation system operatively connected to the drill cuttings cleaning system for distilling solvent and recovering cleaned solvent and hydrocarbons for re-use.

14. The system as in claim 1 further comprising a purge gas system operatively connected to the drill cuttings cleaning system for circulating a purge gas within the drill cuttings cleaning system.

15. The system as in claim 6 wherein the solvent inlet includes a plurality of nozzles positioned on a dry side of the auger to effect cleaning of the auger and pipe.

16. The system as in claim 7 wherein the pipe includes separate outlets for removing water and solvent from the pipe at different vertical positions adjacent the lower end.

17. A drill cuttings cleaning system for cleaning hydrocarbon contaminated drill cuttings comprising:

an angled pipe having a top end, middle portion and a lower end, the angled pipe operatively containing an auger for countercurrent movement of contaminated drill cuttings and a cleaning solvent with respect to one another within the angled pipe, the angled pipe having a drill cuttings inlet adjacent the lower end, a drill cuttings outlet adjacent the top end, solvent inlet adjacent the middle portion and a solvent outlet adjacent the lower end;

wherein rotation of the auger within the pipe effects movement of drill cuttings with respect to the solvent for cleaning the contaminated drill cuttings without substantial degradation of particle size of the drill cuttings;

a drying system operatively connected to the angled pipe, the drying system comprising:

a drying pipe angled to define an upper end and a lower end;

a drying auger operatively contained in the angled pipe, the drying auger having an outer flighting and an inner flighting;

a dryer drill cuttings inlet adjacent the lower end of the drying pipe;

a dryer drill cuttings outlet adjacent the upper end of the drying pipe;

a solvent vapour outlet attached to the drying pipe; and a heating system operatively connected to the exterior of the drying pipe for heating drill cuttings within the drying pipe.

18. A method of cleaning drill cuttings in at least one pipe and auger cleaning system comprising the steps of:

a) introducing contaminated drill cuttings and a cleaning solvent into the pipe and auger cleaning system;

b) flowing the contaminated drill cuttings and cleaning solvent in a countercurrent direction with respect to one another;

c) collecting and distilling cleaning solvent from the pipe and auger cleaning and re-circulating cleaned solvent through the pipe and auger cleaning system; and, d) recovering cleaned drill cuttings from the pipe and auger cleaning system, introducing the cleaned drill cuttings into a drying system, and heating the pipe and auger drying system to effect evaporation of solvent from the cleaned drill cuttings while moving cleaned drill cuttings within the pipe and auger drying system.

19. A method as in claim 18 wherein the auger of the pipe and auger system is rotated at a rate that does not cause substantive structural degradation of the contaminated drill cuttings.

20. The method as in claim 18 wherein the ratio of solvent to drill cuttings in the pipe is at least 2:1.

21. The method as in claim 18 where the cleaning solvent is any one of n-butyl alcohol, hexane or ethyl acetate.

22. The method as in claim 18 wherein the contaminated drill cuttings are cleaned at an approximate average rate of 16 volumetric liters per minute.

23. The method as in claim 18 wherein the contaminated drill cuttings are in contact with the cleaning solvent for about 15 minutes.

* * * * *